US007377020B1

(12) United States Patent
Bartling et al.

(10) Patent No.: US 7,377,020 B1
(45) Date of Patent: May 27, 2008

(54) FENCE POST BRACING SYSTEM

(76) Inventors: Alan Louis Bartling, 7785 Lakeshore Dr., Sagle, ID (US) 83860-8534; Richard Bard, Jr., 7785 Lakeshore Dr., Sagle, ID (US) 83860-8534; Maynard Earl Kincaide, Jr., 1653 Elk Grove Rd., Sandpoint, ID (US) 83864-7998

( * ) Notice: Subject to any disclaimer, the term of this patent is extended or adjusted under 35 U.S.C. 154(b) by 0 days.

(21) Appl. No.: 11/467,559

(22) Filed: Aug. 27, 2006

(51) Int. Cl.
*B23P 11/00* (2006.01)
*E04H 17/02* (2006.01)

(52) U.S. Cl. ..... 29/525.01; 29/469; 29/428; 29/557; 256/35; 256/36

(58) Field of Classification Search ..... 29/525.01, 29/469, 557, 428; 256/19, 30, 31, 35, 63, 256/64
See application file for complete search history.

(56) References Cited

U.S. PATENT DOCUMENTS

| | | | | | |
|---|---|---|---|---|---|
| 301,683 | A | * | 7/1884 | Combs | 256/42 |
| 314,785 | A | * | 3/1885 | Bissell | 256/35 |
| 387,413 | A | * | 8/1888 | Griffin et al. | 52/151 |
| 401,450 | A | * | 4/1889 | Mitchell | 256/39 |
| 471,160 | A | * | 3/1892 | Winslow | 256/30 |
| 485,304 | A | * | 11/1892 | Spillinger | 256/39 |
| 505,357 | A | * | 9/1893 | Hansbarger | 256/58 |
| 605,393 | A | * | 6/1898 | Childers | 256/35 |
| 606,530 | A | * | 6/1898 | Flesher et al. | 256/35 |
| 801,540 | A | * | 10/1905 | Morgan | 256/35 |
| 1,018,894 | A | * | 2/1912 | Fournie | 256/35 |
| 1,086,441 | A | * | 2/1914 | Colvin | 256/35 |
| 1,375,398 | A | * | 4/1921 | Leonard | 52/146 |
| 1,811,217 | A | * | 6/1931 | Spaugh | 52/151 |
| 2,147,496 | A | * | 2/1939 | Nelson | 52/150 |
| 3,785,107 | A | | 1/1974 | Garretson | |
| 4,349,181 | A | | 9/1982 | Asher et al. | |
| 4,679,772 | A | * | 7/1987 | Peterson | 256/36 |
| 4,705,262 | A | * | 11/1987 | Roberts | 256/37 |
| 4,763,879 | A | | 8/1988 | Wasicek et al. | |
| 4,893,787 | A | | 1/1990 | Watson | |
| 4,909,483 | A | * | 3/1990 | van Herpen | 256/59 |
| 5,042,780 | A | | 8/1991 | Yearwood | |
| 5,061,109 | A | | 10/1991 | Miller | |

(Continued)

FOREIGN PATENT DOCUMENTS

| | | |
|---|---|---|
| GB | 2 295 628 | 6/1996 |

*Primary Examiner*—Essama Omgba
(74) *Attorney, Agent, or Firm*—Swift Law Office; Stephen Christopher Swift

(57) ABSTRACT

A method of constructing fences, and fences constructed using the method. Posts are set into the ground. Flat pieces called "floating deadmen" are set on the ground. Braces are sawed off at forty-five degree angles on each end, so that they have flat ends at right angles. A spot on the side of the post is flattened, so a flat end of a brace can fit flush against it. The brace is then placed so that the other one of its flattened ends lies on the floating deadmen. A length of wire is cut, and its ends are joined by a stainer. The loop of wire is then placed around the post and brace, and is tightened using the strainer. The tops of terminal and corner posts are joined to adjacent posts by rails. Fencing wire holders are fastened to the posts, and fencing wire is placed in the holders.

12 Claims, 12 Drawing Sheets

U.S. PATENT DOCUMENTS 5,139,235 A 8/1992 Kilmer
5,577,713 A 11/1996 Navarez
5,649,690 A * 7/1997 Kilmer ..... 256/35
5,738,342 A 4/1998 Van Winkle
5,911,411 A 6/1999 Krause et al.
6,340,151 B1 1/2002 Snow
6,443,655 B1 * 9/2002 Bennett ..... 405/114
6,527,255 B2 3/2003 O'Berry et al.
6,622,436 B1 9/2003 Kretsch
6,866,252 B2 3/2005 Pulliam

* cited by examiner

FENCE POST BRACING SYSTEM

BACKGROUND OF THE INVENTION

1. Field of the Invention

The present invention relates to methods and apparatus for a fence post brancing system.

2. Description of the Prior Art

As they age, the corners of fences for livestock tend to cave in towards the direction of the tension in the fence. This is a gradual process, rather than the result of sudden movement. The present invention addresses this problem, in a way that is not shown in the prior art.

U.S. Pat. No. 3,785,107, issued on Jan. 15, 1974, to George W. Garretson, discloses a repair assembly for fences posts including bracing rods. The instant invention is distinguishable, in that it is a system for the original construction of a fence, rather than its repair.

U.S. Pat. No. 4,349,181, issued on Sep. 14, 1982, to Lynn E. Asher and Antony J. Conway, discloses an end or corner fence post construction, including a brace resting on a deadman plate below ground level. The instant invention is distinguishable, in that it has a floating deadman and wire straps for reinforcement.

U.S. Pat. No. 4,763,879, issued on Aug. 16, 1988, to Michael D. Wasicek and Larry D. Wasicek, discloses a metal fence post connector, including braces. The instant invention is distinguishable, in that it is for wooden fences.

U.S. Pat. No. 4,893,787, issued to Jan. 16, 1990, to Terry D. Watson, discloses a fence corner post with a brace and strut, all made of steel. The instant invention is distinguishable, in that it is for wooden fences.

U.S. Pat. No. 5,042,780, issued on Aug. 27, 1991, to M. Dean Yearwood, discloses a metal brace for supporting a metal fence post. The instant invention is distinguishable, in that it is for wooden fences.

U.S. Pat. No. 5,061,109, issued on Oct. 29, 1991, to Donald Miller, discloses fence post bracing and a method of installation in a section of fence, without the use of a floating deadman as in the instant invention.

U.S. Pat. NO. 5,139,235, issued on Aug. 18, 1992, to Willis G. Kilmen, discloses a corner fence post system, with braces having auger flights underground, rather than floating deadmen, as in the instant invention.

U.S. Pat. No. 5,577,716, issued on Nov. 26, 1996, to Jack Navarez, discloses a post support with offset slanted stake, without the use of a floating deadman or wire straps as in the instant invention.

U.S. Pat. No. 5,738,342, issued on Apr. 14, 1998, to Lonnie Van Winkle, discloses a fence corner arrangement with interlocking posts and braces, without diagonal braces resting on floating deadmen, as in the instant invention.

U.S. Pat. No. 5,911,411, issued on Jun. 15, 1999, to Trevor Krause and Anthony John Baillieu, discloses a combination strainer and stay and thrust member. Unlike the brace of the instant invention, the prop member is not cut at a forty five degree angle at its edges, but fits into a hole in the post and a groove in the thrust member.

U.S. Pat. No. 6,340,151, issued on Jan. 22, 2002, to Jimmy D. Snow, discloses fence cornerpost assembly brackets, but does not disclose a brace resting on a floating deadman, as in the instant invention.

U.S. Pat. No. 6,527,255, issued on Mar. 4, 2003, to O'Berry et al., discloses a flat fence post protector that lies on the surface of the ground and supports a vertical post, but does not disclose a diagonal brace resting on a floating deadman, as in the instant invention.

U.S. Pat. No. 6,622,436, issued on Sep. 23, 2003, to Kevin Robert Kretsch, discloses a goose barrier, with a spool for tightening a line between posts. There are no braces, as in the instant invention.

U.S. Pat. No. 6,866,252, issued on Mar. 15, 2005, to Bryan J. Pulliam, discloses a portable fencing system, with a winch for tightening wires and ground anchor stakes, rather than braces resting on floating deadmen, as in the instant invention.

British Patent No. 2 295 628, published on Jun. 5, 1996, inventor Malcolm Peter Carl Tandy, discloses a brace for a fencing system, with post supports that are driven into the ground, rather than floating deadmen that rest on the ground, as in the instant invention.

None of the above inventions and patents, taken either singly or in combination, is seen to describe the instant invention as claimed.

SUMMARY OF THE INVENTION

The present invention is a fence post bracing system utilizing a floating deadman and a ratcheting braces. It is designed to automatically react to thermal expansion and contraction, including frost heave. It is designed for farmers and ranchers who want to build a fence as quickly and securely as possible, while eliminating costly maintenance. It may be used for any type of fencing, but especially high tensile electrified fencing. For inside, outside and extended corners and terminal posts, it uses a brace and rail between two or more set posts, with strap support. Wrap around wires pull from the center of the braces.

Accordingly, it is a principal object of the invention to provide an improved system for bracing fence posts.

It is another object of the invention to provide fences that can better withstand the effects of temperature changes.

It is a further object of the invention to provide economical fencing for farmers and ranchers.

Still another object of the invention is to provide fencing with reduced maintenance costs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a method of constructing a fence, and a fence constructed using the method.

The posts, braces and rails of the present invention are preferably made from logs with the bark still on them, but other members made from any suitable material may be substituted. The logs or other members used for the posts may be thicker than those used for the braces and rails. Logs or members of one size may be used for posts, a second size used for braces, and a third size used for rails.

While a chain saw may be used to construct the fence, it is just as effective to use hand tools, such as a hand saw, chisel and hammer, or a rechargeable reciprocating saw, and those not qualified, with faulty equipment, not sufficiently cautious, or without required extra equipment (including chaps, safety glasses, headgear, and gloves) should use hand tools. Whenever a chain saw is mentioned below, it should be understood the hand tools may be substituted.

Figure 1:
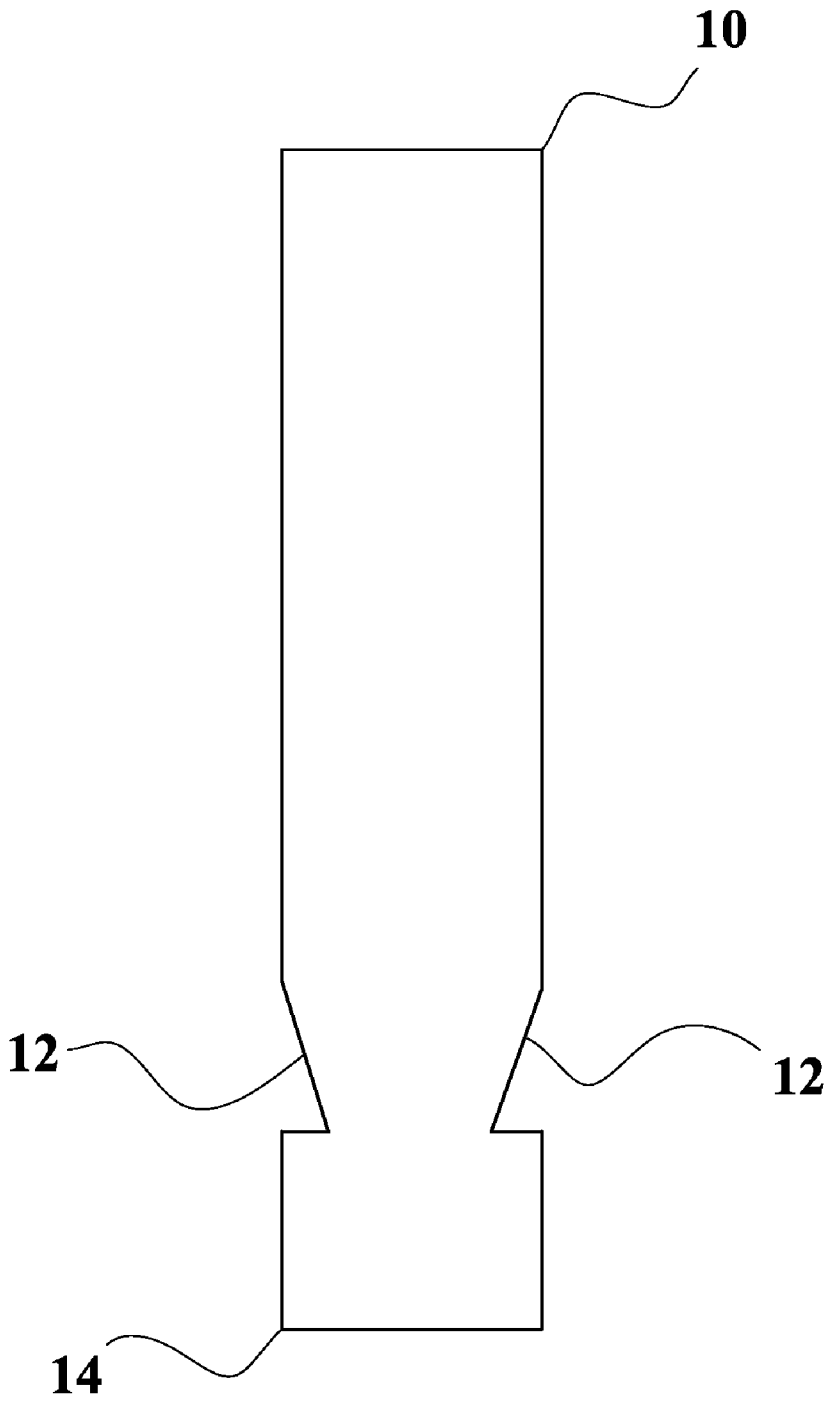
FIG. 1 is a front elevational view of the notched post of the preferred embodiment of the invention.

Setting the fence post is critical to bracing the post. Branching can never overcome an improperly set post. A post that is not set deep enough or securely enough can never overcome an improperly set post. The best post set is the mechanical set with a post driver attached to a tractor or other equipment, but when that is not available or necessary, digging the hole with a post-hole digger and hand setting is satisfactory. The post should be notched with a chain saw when hand setting, so that the fill in the hole will work in favor of keeping the post in the ground and prevent the post from turning in the hole. FIG. 1 shows a post 10 with notches 12 near its bottom end 14. Notching is essential, as otherwise the forces in the system will tend to pull the post straight out of the ground, along with the double brace required in the corners. It is preferable that the bark be left on the posts, as the bark will tend to hold them in the ground. The larger the diameter of the post and the deeper it is set, the better the post will stay in the ground. The position of the post in the ground must be sufficient to adequately secure the portion above the ground. For example, an eight-foot post sunk three feet deep in the ground is in proper proportion.

It is preferable to use three quarter minus gravel (i.e., gravel that has been passed through a sieve with openings no larger than three quarters of an inch) to fill the space between the sides and bottom of the hole and the post. First, fill the bed of the hole with three inches of gravel and use the post to tamp it down firmly. Fill gravel around the post six inches at a time, and tamp completely around the post with a metal tamping rod, stick or other suitable instrument.

Figure 2:
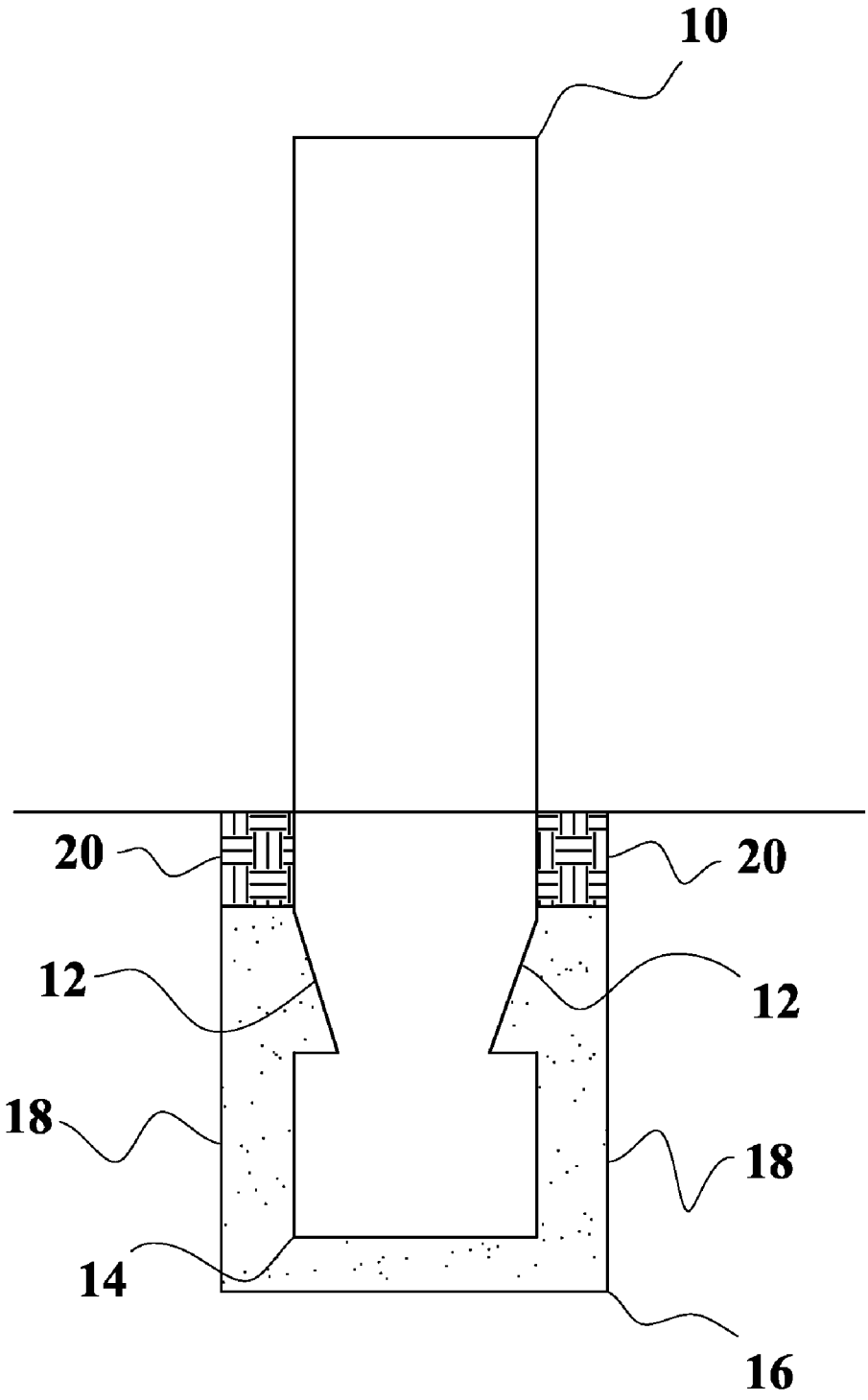
FIG. 2 is a sectional view of the notched post and the hole in which it is set in the ground.

Plumb the post to insure that it is vertical, using a level with a bubble indicator or other suitable instrument. Fill and tamp gravel until it fills the space between the post and the sides of the hole to about three inches below the surface of the ground. Fill the remaining space with topsoil (such as that removed in digging the hole). FIG. 2 shows how the post is set in the ground in hole 16 filled with gravel 18 and topsoil 20.

Figure 3:
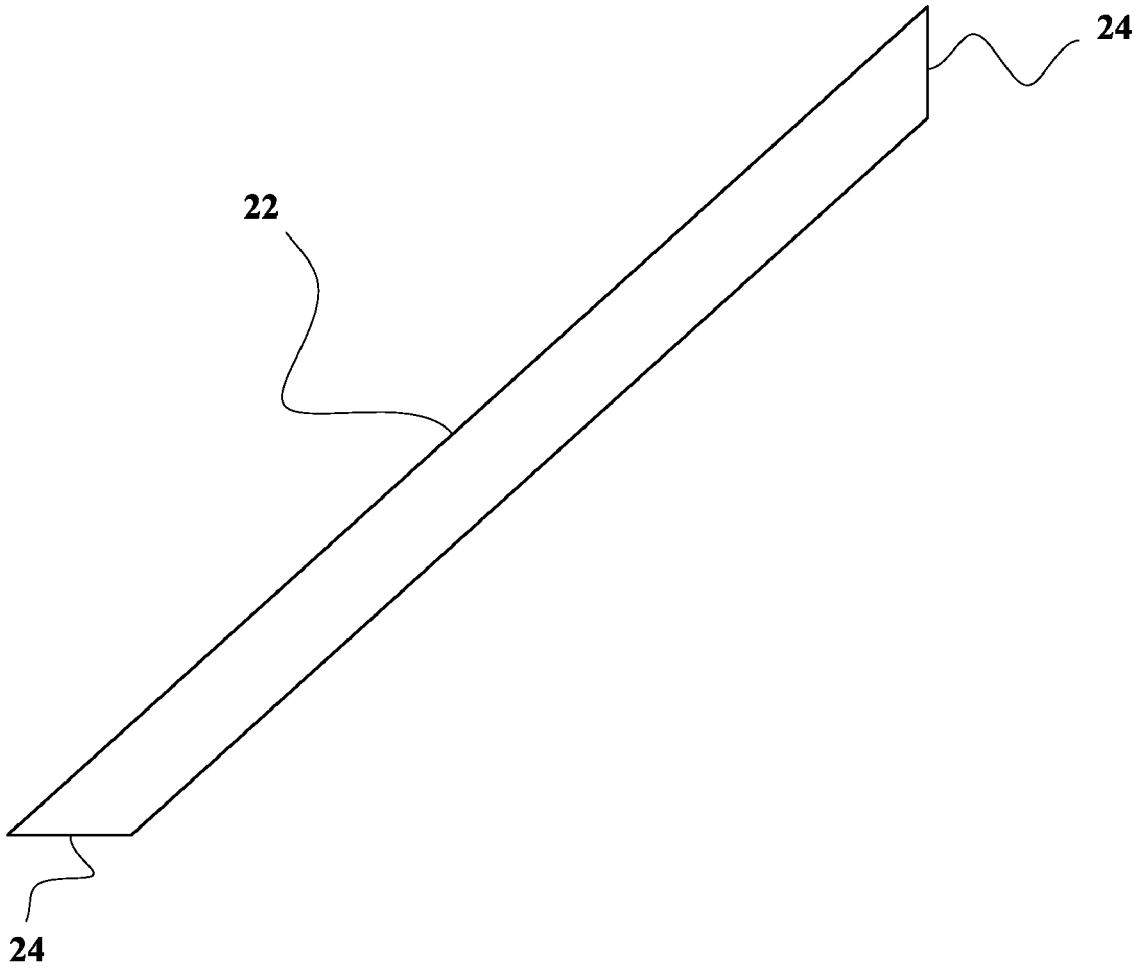
FIG. 3 is a front elevational view of the brace of the preferred embodiment of the invention.

Some or all of the posts may be supported by braces. It is preferable that the brace be thin enough to bend a little under stress from the wire strainer, as this will ensure that the wire strap will always have tension applied to the brace, even if the tension loosens up a bit. A workbench (such as the BLACK & DECKER WORKMATE) may be used to hold the brace steady when it is being marked and cut. The brace may be prepared by marking a forty-five degree angle with a carpenter's square and felt tip marker. Then the end of the brace may be cut off along the line marked using a chain saw. Then measure the brace from the longest part of the new cut end to the finished length, preferably at sixty-nine niches. This length gives you a forty-five degree angle when one end of the brace is set on the post four feet above the ground and the other end of the brace four feet horizontally away from the post. Then mark the other end of the brace using the square and felt tip marker at forty-five degrees, and cut it off as before, preferably in such a manner that the distance between the longest part of each end is sixty-nine inches. FIG. 3 shows the finished brace 22, with its two cut surfaces 24 perpendicular to each other. If the user does not move the brace in the WORKMATE, the angles cut should be relatively even with each other. However, it is easier and more accurate to cut the braces in a shop using a miter saw.

Figure 4:
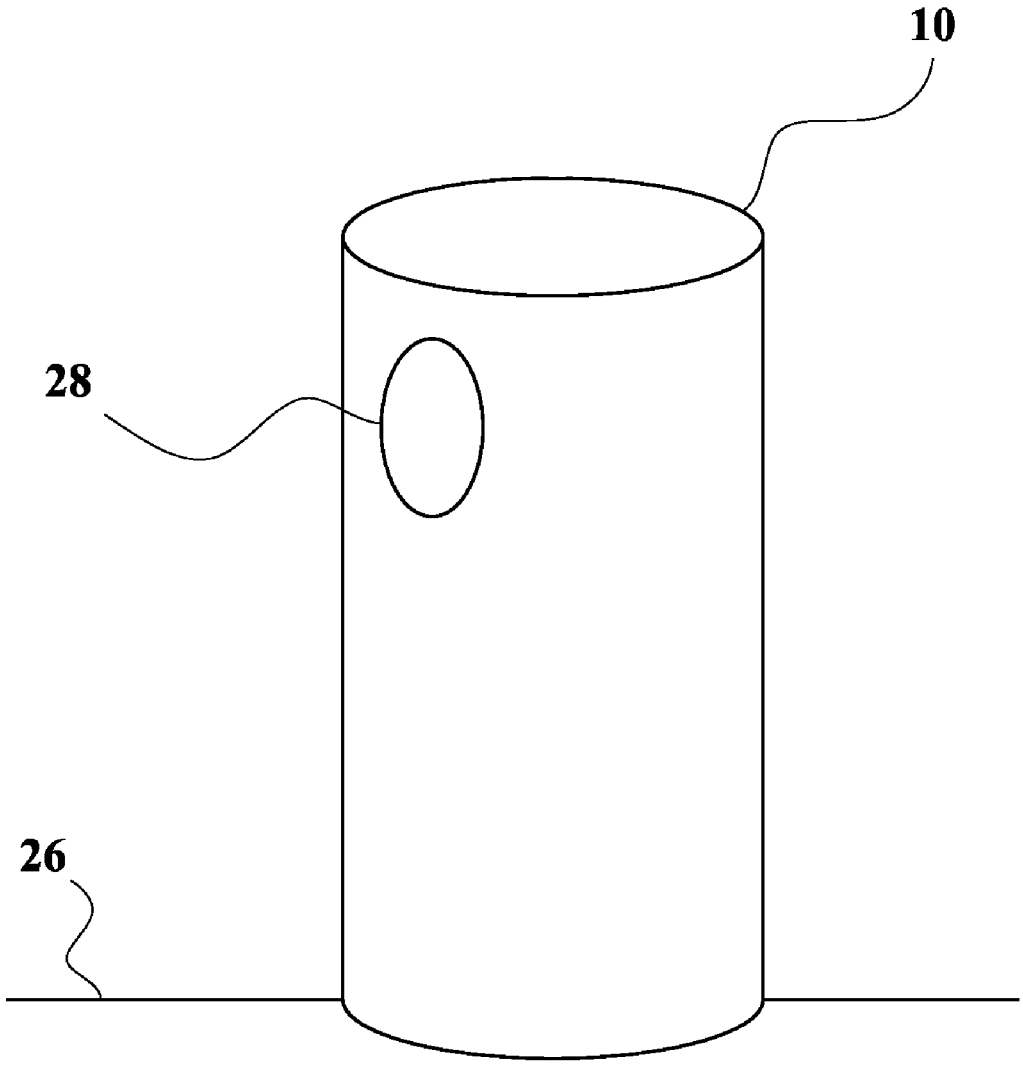
FIG. 4 is a perspective view of the post set in the ground, with a flattened spot for receiving the brace.

Preparing the post for the brace requires good saw work. The first step is to measure and mark forty eight inches up from the ground on the post. Next measure the length of the cut on the end of the brace you are going to set against the post, along the longest dimension of the cut surface. Mark that length down from the forty-eight inch line previously marked on the post. Carefully using the chain saw, remove the bark and flatten a spot in the place where you are going to set the brace or the post. No more wood should be removed than necessary to create a flat spot on the post of the size of the cut surface of the brace to be joined to it. FIG. 4 is a perspective view of the post 10 extending above the ground 26 showing the flat spot 28.

Figure 5:
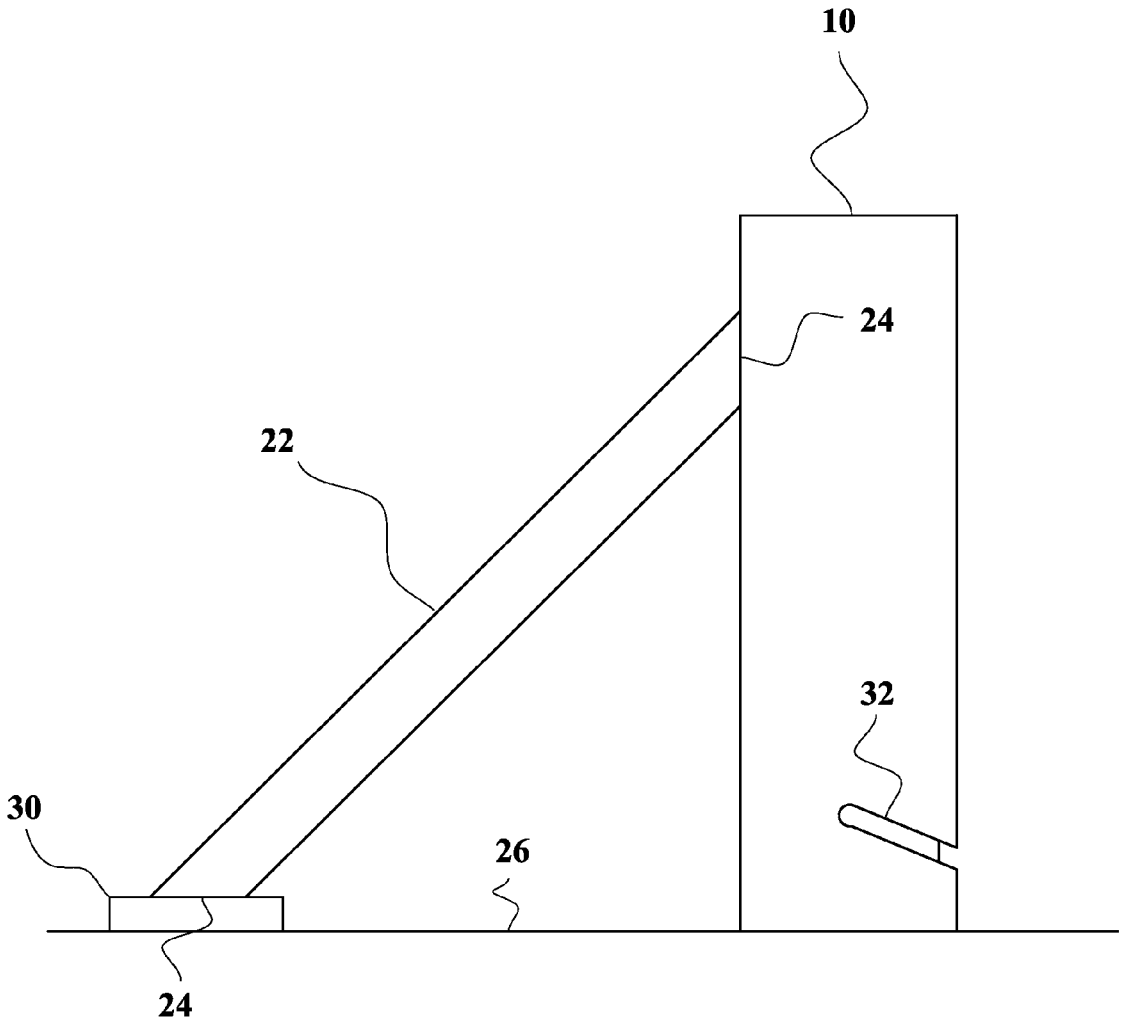
FIG. 5 is a front elevational view of the assembled post, brace and floating deadman of the preferred embodiment of the invention.

FIG. 5 is an elevational view showing the brace 22 with its ends 24 resting against the post 10 and the floating deadman 30. A plate that rests on the ground to anchor a fence brace is known in the West as a "floating deadman". The nature of the ground will determine what kind of material it is best to use as a floating deadman. If the post and brace are to be set in a wet soggy area, a treated four by six inch beam about two feet long may be necessary, as the weight and pressure of the fencing system bears on the plate, tending to force it into the ground. For other type of ground, use a concrete pad or flat rock for the floating deadman. The ground should not be disturbed, unless necessary to level the plate. Set the plate on the ground, and visually line it up in the direction determined by which post you are setting. Braces for corner posts should by aligned in the direction of pull from the fence. Braces for terminal posts should be aligned in the opposite direction of the pull of the wire. Preferably, the furthest edge of the plate should be set four feet and six inches from the post. Alternatively, the brace may be centered on the plate, the closer the post, brace and ground come to forming a right triangle, the better the brace and wire strap will support the post, as they will exert equal pressure both ways. It may be necessary to use a shorter or longer brace when the ground is uneven, to keep the proportions close and the top of the brace near the top wire.

Notching the post for a brace wire (hereinafter referred to a "wire strap") with a chain saw requires bending down and carefully cutting a small groove (32 in FIG. 5) in the post, so that the wire strap will seat itself and not slip once you tighten the wire strainer. It is recommended to use twelve and a half gauge, Class 3 galvanized wire, able to withstand 200,000 pounds per square inch of tension. Once in place, the wire will follow a forty-five degree path to the midpoint of the brace from the groove in the back of the post. To form the groove, place your square on the ground and use the post to align the square vertically and mark a forty-five degree line on both sides of the post. With a chain saw, circle around the post at the forty five degree angle, and make a small groove that the wire can follow, stopping where the wire will loose contact with the post. (Small cordless chain saws work well for this job.)

Figure 6:
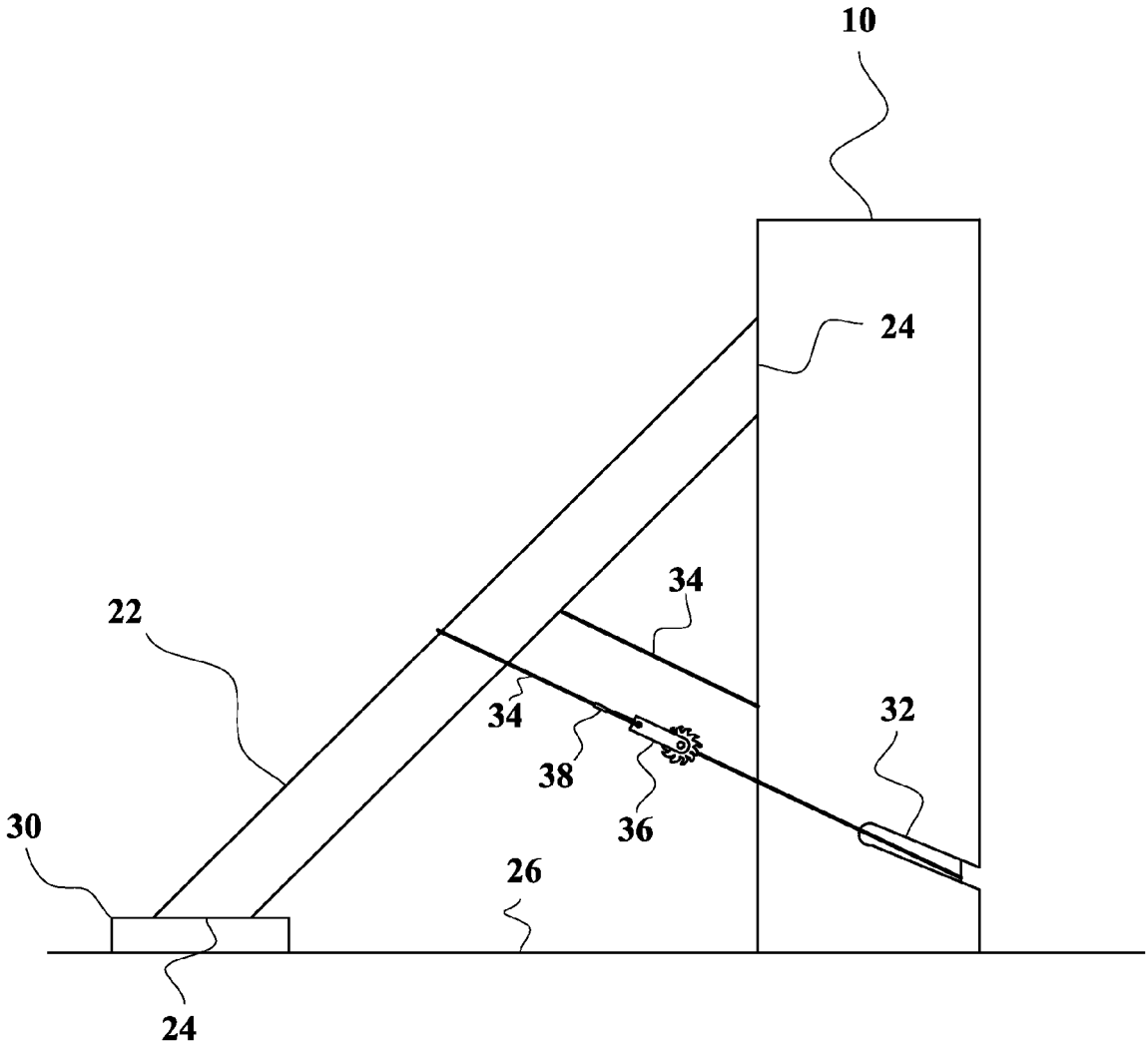
FIG. 6 is a front elevational view of the assembled post, brace, floating deadman, wire strap and wire strainer of the preferred embodiment of the invention.

FIG. 6 shows the wire strap 34 attached to the post and brace, using the wire strainer 36. With small bolt cutters, cut an eight foot piece of the 12 ½ gauge wire for use as a strap. Buy a good wire strainer at your local Co op or other store and place it in the WORKMATE or other portable workbench. Attach the strainer to the wire using a crimping tool to secure the wire with a crimp sleeve 38. Insert the other end of the wire into the strap and bend it away from the direction of tightening with linesman pliers. Drop the wire strap over the post and brace at a forty-five degree angle, insert it into the notched groove, and then tighten the strainer.

Tightening of braces for corner and terminal posts is a delicate matter, and the preferred procedure should be followed carefully. The brace exerts equal pressure down to the floating deadman and against the post away from the direction that the fence will pull. This eliminates the need for excessive pressure on the strap. It is not necessary, nor it is recommended, to nail or screw the brace to the post. If there is excessive pressure on the strap, a gap may form in the ground next to the post. A rule of thumb is that when the post starts to move or a bow develops in the brace, stop tightening the strap. If the post becomes too loose from excessive pressure on the strap, you may need to re set the post. Tamping the ground on the surface will not re set a post that has been loosened. The physics of the method of the invention are enough to hold the fence post in place without excessive pressure being applied to the strap. It is cetriimental to the invention's system to loosen the post and start it moving. When two braces are required, as against a corner post, the force is upward on the post. Always avoid excessive force on the post, which can cause it to move out of the ground, or at least loosen it to the extent that it needs to be reset.

Figure 7:
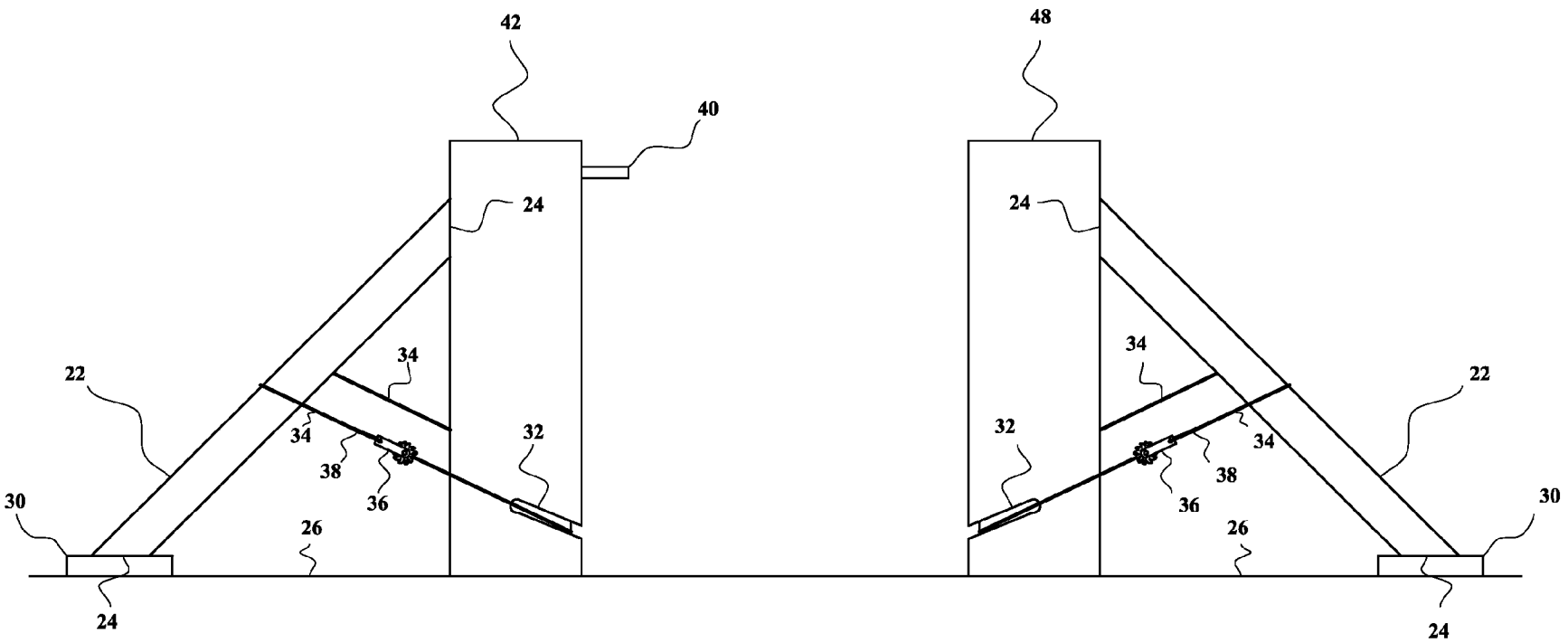
FIG. 7 is a front elevational view of two posts, showing a first step in attaching a rail between them.
Figure 8:
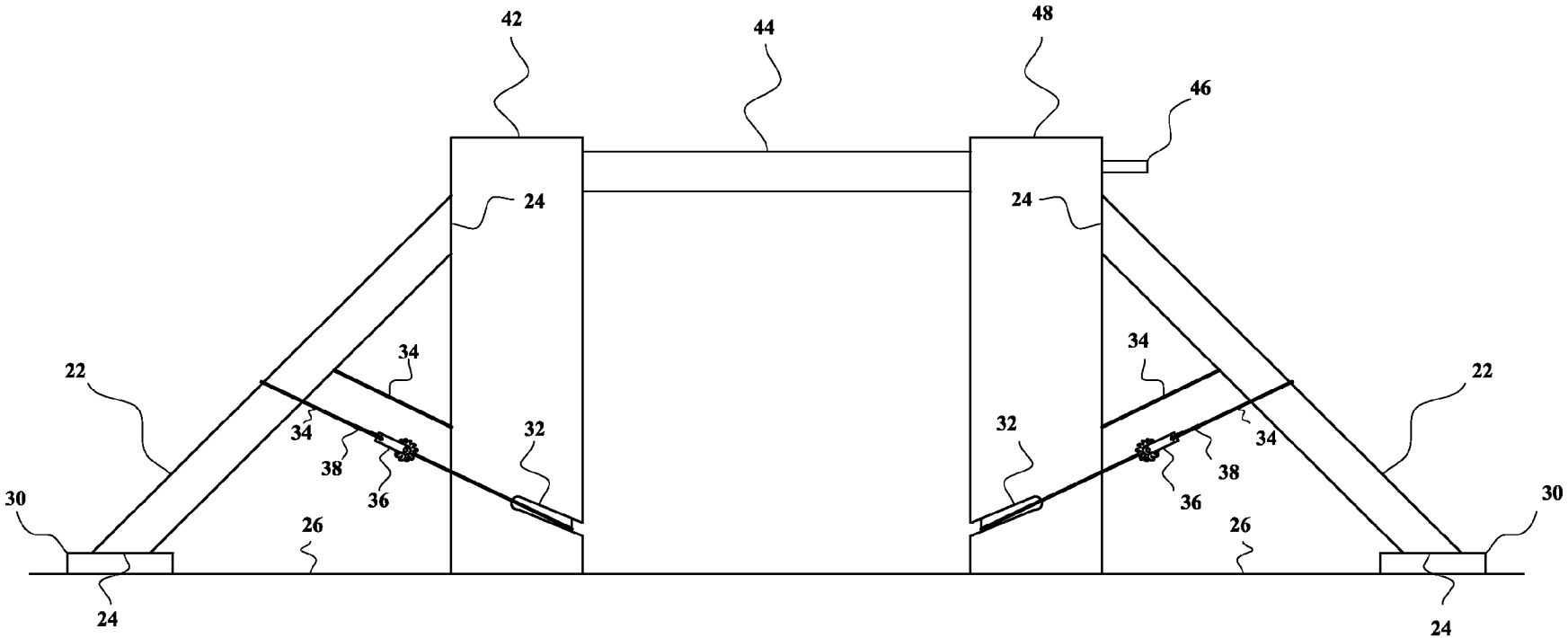
FIG. 8 is a front elevational view of two posts, showing later steps in attaching a rail between them.
Figure 9:
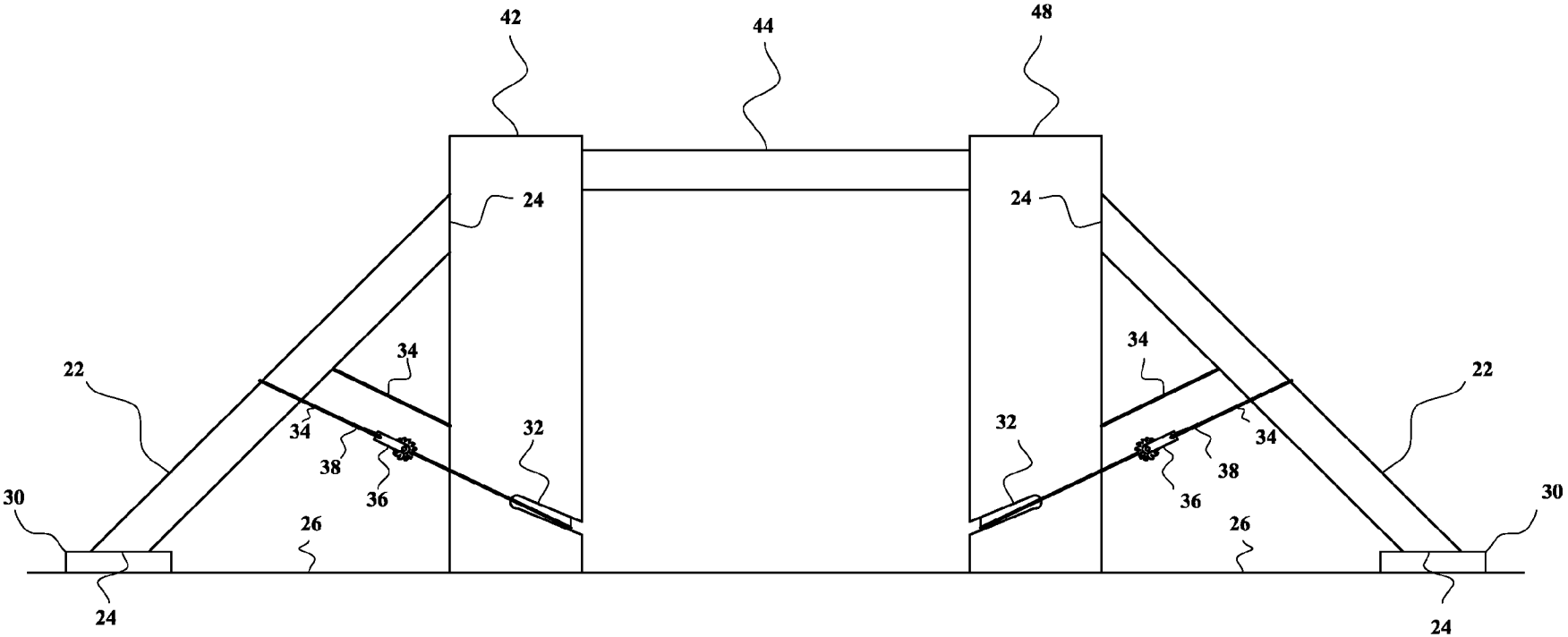
FIG. 9 is a front elevational view of two posts connected by a rail in the preferred embodiment of the invention.
Figure 10:
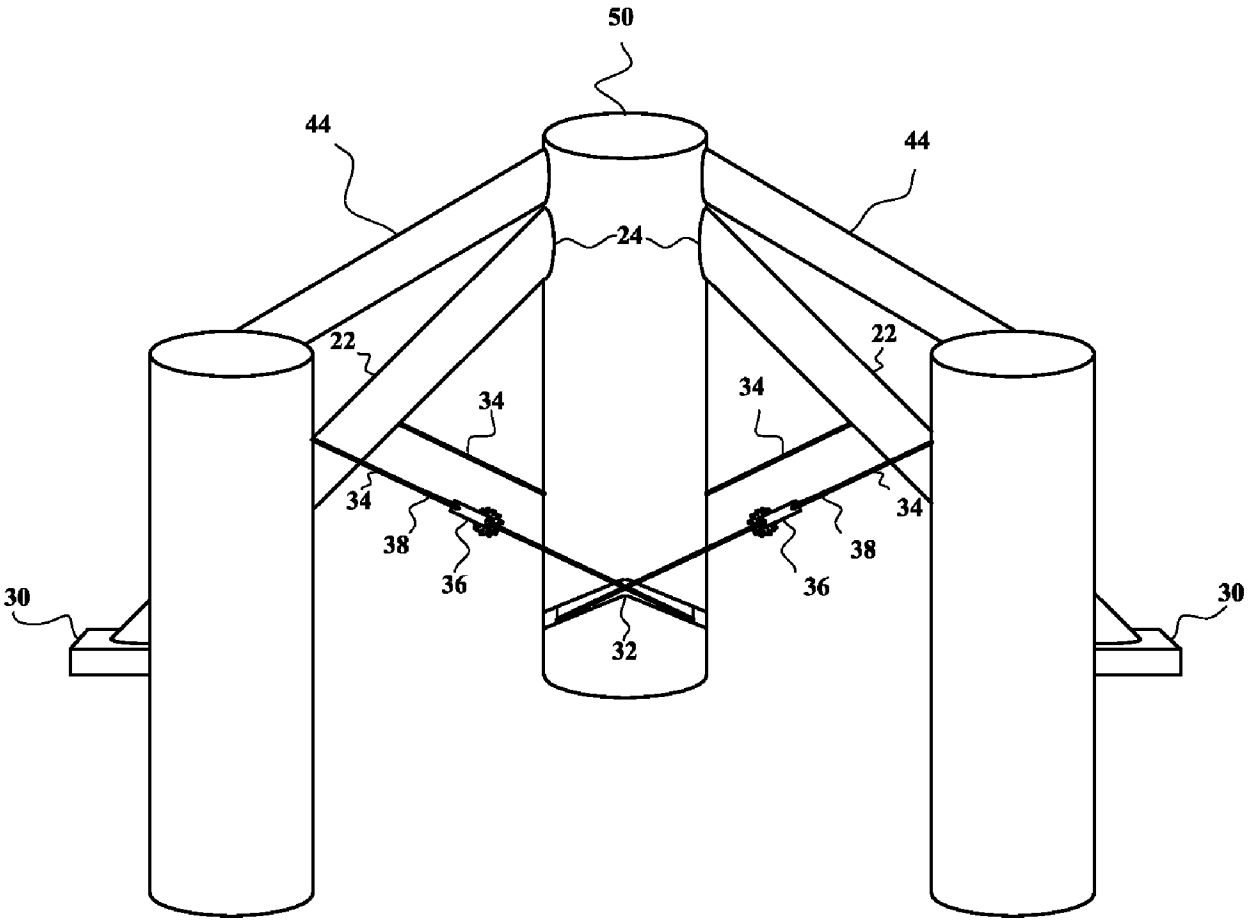
FIG. 10 is a perspective view of a fence corner, before the attachment of fencing wires.

Rails are required for corner and terminal (end) posts. For each post that is at an end of the fence, fasteners are inserted into said post and the post nearest to said post, and a rail is inserted between the fasteners. For each post that is at a corner of the fence, fasteners are inserted into said post and the two posts nearest to said post, and rails are inserted between the fasteners. The rails add support to the posts and tie the corner or terminal set together, to eliminate twisting. Twisting is a cause of loosening posts, which increases maintenance costs. The preferred method of attaching rails between two posts is as follows: Drill a four inch by three eights inch hole in the first post. Drive four inches of an eight inch by three eights inches piece of rebar (or manufactured pin or other suitable fastener) into the hole in the first posts. FIG. 7 shows the rebar 40 inserted into the first post 42. Drill a four by three-eights inch hole in the center of one end of the rail. Drive the rail (44 in FIG. 8) onto the rebar, which will now securely hold the rail to the first post. Then drive a second eight inch by three-eights inch piece of rebar (46 in FIG. 8) all the way through a second post (48 in FIG. 8) into the opposite end of the rail. A rope doped around the posts and attached to a pulley (or "come-along") may be required to force the posts together. FIG. 9 shows the rail attached between the posts. FIG. 10 shows two rails 44 attached to a corner post 50. Note that corner posts are also supported by two braces 22.

The fence may be completed by attaching fencing wire holders to the posts, and placing the fencing wire in the holders. If a plurality of parallel fencing wires are attached to each post, they may all be attached in the same manner. If the fence is to be electrified, the holders should be insulators. Preferably, the wire is wrapped round terminal posts, and attached to an eyebolt in the center of a brace supporting the terminal post. A hole must be drilled through the center of the brace, so that the eyebolt can be inserted. If the fence is to be electrified, substitute an insulator for the eyebolt in the brace (if there is no insulating eye bolt available on the market long enough for use in fencing), and retain the wire in another insulator when it is wrapped around the terminal post. Note that a reason that the wire is wrapped around the terminal post, is because it is necessary to pull from the center to avoid twisting. Eyeballs are the preferred fencing wire holders for corner and terminal posts. For higher fences (e.g., a deer fence around a garden) bulkier rails and bracing in proportion to the height of the posts are necessary. Braces should be positioned at a forty-five degree angle down from the top wire.

Figure 11:
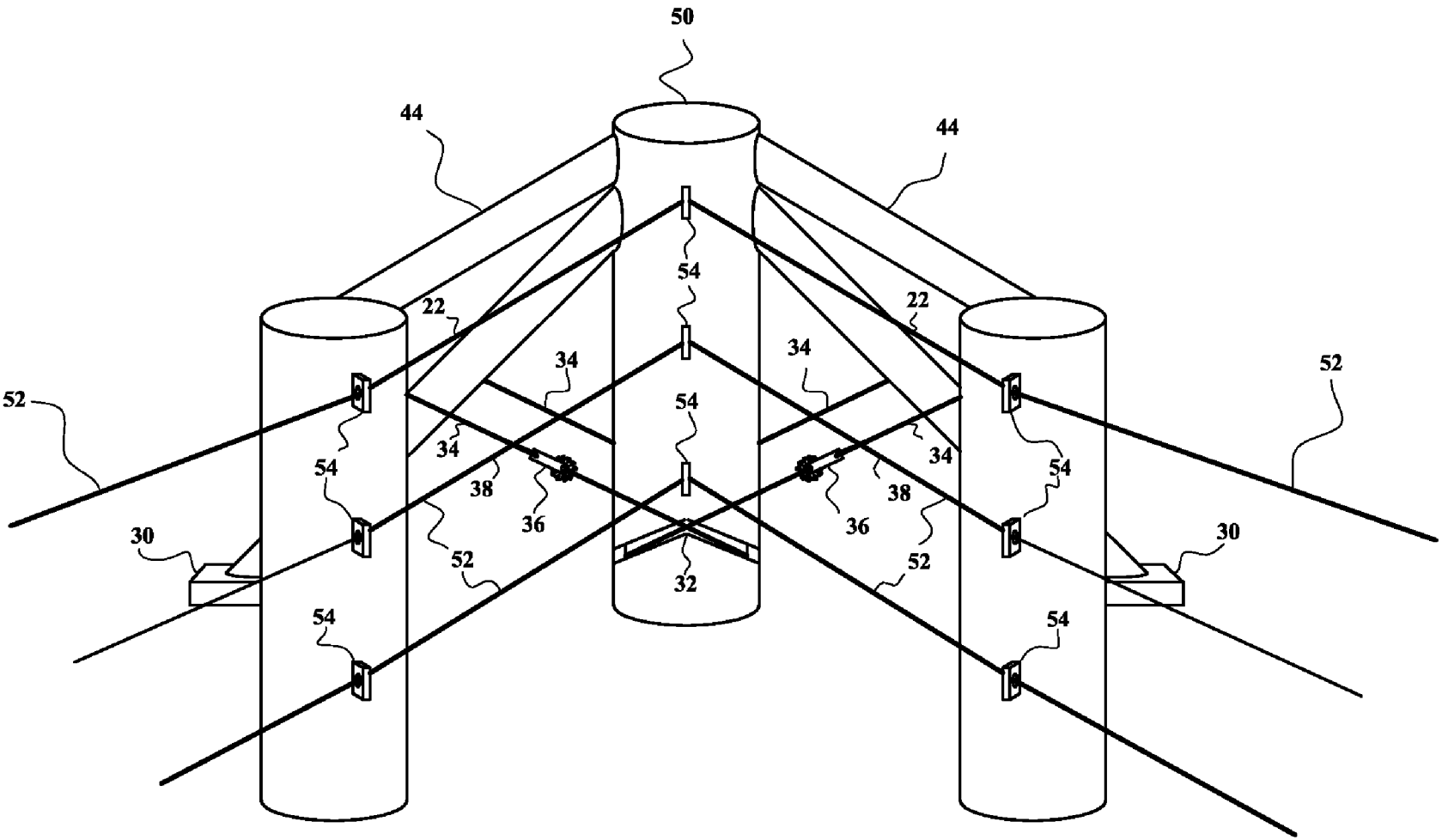
FIG. 11 is a perspective view of a fence corner, after the attachment of fencing wires.
Figure 12:
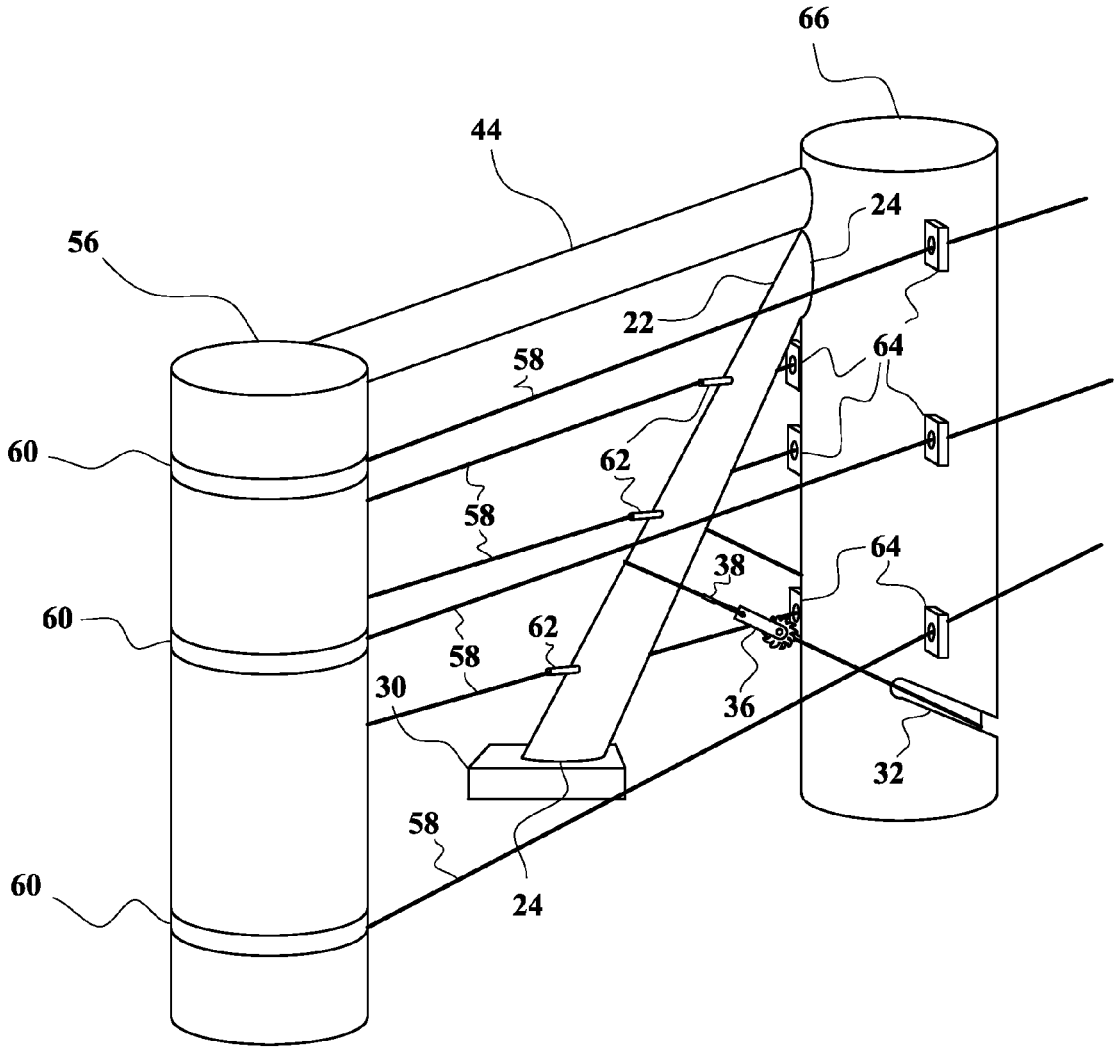
FIG. 12 is a perspective view of a terminal and adjacent fence posts, with insulated fencing wires.

FIG. 11 shows a finished fence corner, with the wires 52 retained on the posts by eyebolts 54. FIG. 12 shows terminal fence post 56 (not supported by a brace) around which are wrapped electrified wires 58 that pass through curved insulators 60 on the terminal post, and straight insulators 62 passing through the brace 22. The wires also pass through insulating fencing wire holder 64 on the post 66 adjacent to the terminal post.

It is to be understood that the present invention is not limited to the sole embodiment described above, but encompasses any and all embodiments within the scope of the following claims.

We claim:

1. A method of constructing a fence, comprising the steps of:

obtaining logs of a first size to be used as posts;

obtaining logs of a second size to be used as braces;

obtaining plates to be used as floating deadmen;

digging holes for the posts;

inserting the posts in the holes;

plumbing the posts to make sure that they are vertical, and adjusting the posts if necessary to make them vertical; and placing the plates to be used as flowing deadman on the around at a first distance from the posts, and placing the braces against the posts and floating deadmen, in such a manner that one end of each brace rests on a floating deadman, while the other end of each brace rests against a post;

obtaining wire for straps and wire strainers;

cutting grooves in the posts for retaining wire straps;

cutting the wire into suitable lengths to be used as the wire straps;

attaching opposite ends of each wire strap to one of the wire strainers;

placing each wire strap around one of the posts and one of the braces, with a portion of the wire strap in said groove in the post; and tightening the wire strainers.

2. The method of constructing a fence according to claim 1 comprising the further steps of:

obtaining logs of a third size to be used as rails;

obtaining fasteners;

for each post that is at an end of the fence, inserting fasteners into said post and the post nearest to said post, and inserting a rail between the fasteners; and for each post that is at a corner of the fence, supporting said post by two braces, inserting fasteners into said post and the two post nearest to said posts, and inserting rails between the fasteners.

3. The method of constructing a fence according to claim 2, comprising the further steps of:

obtaining wire for fencing wire and fencing wire holders; and attaching the fencing wire holders to the posts, and placing the fencing wire in said holders.

4. The method of constructing a fence according to claim 3, comprising the further steps of:

before inserting the posts into the holes, cutting notches in opposite sides of the bottom end of each post, while leaving bark on the posts, and filling the bottoms of the holes with gravel;

after inserting the posts into the holes, tamping down the gravel with the posts, putting more gravel in the holes around the sides of the bottom end of the posts, and tamping down the gravel again with a suitable instrument; and after the posts have been plumbed, adding additional gravel if necessary to fill up each hole around the sides of the bottom end of the post up to a second distance below the surface, and filling up the remaining space in the hole with top soil that has been removed in digging the hole.

5. The method of constructing a fence according to claim 4, comprising the further steps of:

before placing the braces against the posts and floating deadmen, marking forty-five degree angles at opposite ends of the braces, and cutting the ends off the braces, in such a manner that the opposite ends of the brace have flat surfaces that are at right angles to each other.

6. The method of constructing a fence according to claim 5, comprising the further steps of:

before placing the braces against the posts and floating deadmen, placing a first mark on the posts a third distance from the ground, measuring the length of the cut end of each brace to be set against each post, placing a second mark on each post at said length below the first mark, and removing bark and wood between the first and second marks to create a flat surface against which the cut end of the brace can be placed.

7. The method of constructing a fence according to claim 4, comprising the further steps of:

before placing the braces against the posts and floating deadmen, marking forty-five degree angles at opposite ends of the braces, and cutting the ends off the braces, in such a manner that the opposite ends of the brace have flat surfaces that are at right angles to each other.

8. The method of constructing a fence according to claim 7, comprising the further steps of:

before placing the braces against the posts and floating deadmen, placing a first mark on the posts a third distance from the ground, measuring the length of the cut end of each brace to be set against each post, placing a second mark on each post at said length below the first mark, and removing material between the first and second marks to create a flat surface against which the cut end of the brace can be placed.

9. A method of constructing a fence, comprising the steps of:

obtaining members of a first size to be used as posts;

obtaining members of a second size to be used as braces;

obtaining plates to be used as floating deadmen;

digging holes for the posts;

inserting the posts in the holes;

plumbing the posts to make sure that they are vertical, and adjusting the posts if necessary to make them vertical; and placing the plates to be used as floating deadman on the ground at a first distance from the posts, and placing the braces against the posts and floating deadmen, in such a manner that one end of each brace rests on a floating deadman, while the other end of each brace rests against a post;

obtaining wire for straps and wire strainers;

cutting grooves in the posts for retaining wire straps;

cutting the wire into lengths to be used as the wire straps;

attaching opposite ends of each wire strap to one of the wire strainers;

placing each wire strap around one of the posts and one of the braces, with a portion of the wire strap in said groove in the post; and and tightening the wire strainers.

10. The method of constructing a fence according to claim 9, comprising the further steps of:

obtaining members of a third size to be used as rails;

obtaining fasteners;

for each post that is at an end of the fence, inserting fasteners into said post and the post nearest to said post, and inserting a rail between the fasteners; and for each post that is at a corner of the fence, supporting said post by two braces, inserting fasteners into said post and the two posts nearest to said post, and inserting rails between the fasteners.

11. The method of constructing a fence according to claim 10, comprising the further steps of:

obtaining wire for fencing wire and fencing wire holders; and attaching the fencing wire holders to the posts, and placing the fencing wire in said holders.

12. The method of constructing a fence according to claim 11, comprising the further step of:

before inserting the posts into the holes, cutting notches in opposite sides of the bottom end of each post, and filling the bottoms of the holes with gravel;

after inserting the posts into the holes, tamping down the gravel with the posts, putting more gravel in the holes around the sides of the bottom end of the posts, and tamping down the gravel again with a suitable instrument; and after the posts have been plumbed, adding additional gravel if necessary to fill up each hole around the sides of the bottom end of the post up to a second distance below the surface, and filling up the remaining space in the hole with top soil that has been removed in digging the hole.

* * * * *